US005218827A

United States Patent [19]

Pevzner

[11] Patent Number: 5,218,827

[45] Date of Patent: Jun. 15, 1993

[54] PUMPING OF LIQUIFIED GAS

[75] Inventor: Boris Pevzner, Williamsville, N.Y.

[73] Assignee: Praxair Technology, Inc., Danbury, Conn.

[21] Appl. No.: 870,462

[22] Filed: Apr. 17, 1992

[51] Int. Cl.[5] ..... F17C 13/00; F17C 7/04

[52] U.S. Cl. ..... 62/50.6; 62/50.1

[58] Field of Search ..... 62/50.1, 50.2, 50.3, 62/50.4, 50.6, 50.7; 137/210

[56] References Cited

U.S. PATENT DOCUMENTS

| | | | |
|---|---|---|---|
| 814,883 | 3/1906 | Starr | 62/50.6 X |
| 2,292,375 | 8/1942 | Hansen | 62/50.6 |
| 2,580,649 | 1/1952 | Bludeau | 62/50.6 |
| 2,705,873 | 4/1955 | Bonnaud | 62/50.6 |
| 2,973,629 | 3/1961 | Lady | 62/50.6 X |
| 3,234,746 | 2/1966 | Cope | 62/50.6 |
| 4,018,582 | 4/1977 | Hinds et al. | 62/50.4 |
| 4,662,181 | 5/1987 | Brigham | 62/50.6 |
| 4,881,375 | 11/1989 | Mattiola et al. | 62/50.6 |
| 4,917,576 | 4/1990 | Peschka et al. | 62/50.1 X |
| 4,932,214 | 6/1990 | Nieratscher et al. | 62/50.6 |

FOREIGN PATENT DOCUMENTS

| | | | |
|---|---|---|---|
| 0006088 | 1/1981 | Japan | 62/50.6 |
| 0178099 | 10/1983 | Japan | 62/50.6 |
| 0183096 | 4/1963 | Switzerland | 62/50.6 |
| 1019070 | 5/1983 | U.S.S.R. | 62/50.6 |
| 1421287 | 1/1976 | United Kingdom | 62/50.6 |

*Primary Examiner*—Henry A. Bennet
*Assistant Examiner*—C. Kilner
*Attorney, Agent, or Firm*—Peter Kent

[57] ABSTRACT

Method and apparatus for supplying from a vessel to a pump liquified gas with subcooling so as to avoid cavitation during pumping. A supply conduit supplies liquified gas from the vessel bottom to a pump sump which envelops the flowpath elements of a pump and the pump suction. A return conduit returns vapor and excess liquified gas from the sump to the bottom of the vessel. Heating means, preferably heat leak into the return conduit, reduces the density of the fluid in the return conduit thereby increasing the rate of liquified gas flow in the supply conduit and reducing its temperature rise enroute to the pump. Further subcooling is secured by locating the intake to the supply conduit remote from a wall of the vessel in a cooler strata of liquid, and the discharge of the return conduit proximate to a wall of the vessel in a warmer strata in the vessel. The low flow friction losses in the supply and return conduits enhance the circulation rate of liquified gas in the conduits, and the short supply conduit reduces the heat leak into the liquified gas flow in the supply conduit, so that sufficient subcooling is achieved with reduced elevation of the vessel above the pump sump and reduced pressurization of the vessel compared to prior art.

19 Claims, 1 Drawing Sheet

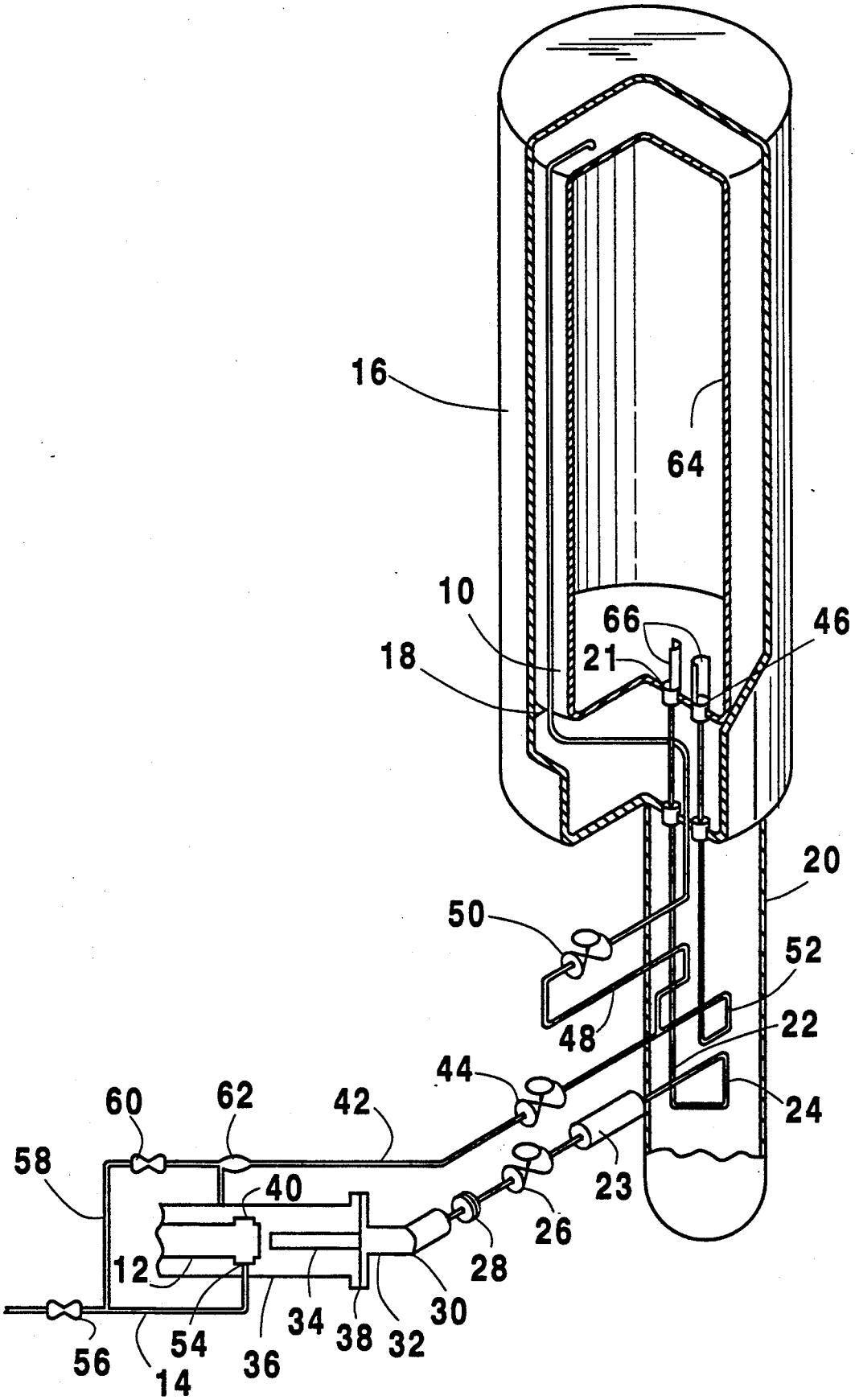
16
64
10
66
46
18
21
20
50
52
48
22
44
24
60
62
42
58
40
23
26
12
28
30
34
38
32
56
54
36
14

PUMPING OF LIQUIFIED GAS

TECHNICAL FIELD

This invention relates to a method and apparatus for the supply of volatile liquids, particularly liquified gases, from a vessel to a pump.

BACKGROUND

Liquified gas is commonly stored in an insulated vessel and supplied from the vessel as needed to a pump. The pump pressurizes the liquified gas to pressures as required, in some applications to pressures as high as 15,000 psig ($1.03\times10^8$ Pa). The pump discharges into a delivery conduit for transfer of the high pressure fluid through a vaporizer to high pressure storage containers or to a use site.

A common problem encountered is flashing of the liquified gas into vapor at the pump suction and cavitation in the pump. The flashing and cavitation can be avoided if the liquid is delivered to the pump suction as a subcooled liquid, i.e., sufficiently below its saturation temperature for the existing pressure. Equivalently, cavitation is avoided if the liquid is delivered to the pump suction as a compressed liquid, i.e., at a pressure sufficiently above its saturation pressure for the existing temperature. While either term, subcooled liquid or compressed liquid can be used, the latter term, subcooled liquid, will be used. Thus subcooling as used herein shall mean cooling a liquid below its saturation pressure at the existing pressure, or pressurizing a liquid above its saturation pressure at the existing temperature. Quantitatively subcooling shall be denoted as the existing pressure over the liquid less the saturation pressure of the liquid at the existing temperature of the liquid.

The prior art has attempted by several devices to achieve subcooling of the liquid delivered from a vessel to the suction of pump to avoid cavitation in the pump. Sufficient subcooling must be supplied to compensate for heat leak and pressure losses in the line from the vessel to the pump. One device has been to allow the pressure developed in the vessel by vaporized liquified gas to rise to the maximum working pressure of the vessel, typically 220 psig ($1.5\times10^6$ Pa). The vaporization and resultant pressure rise have been accomplished by use of a vaporizer or by natural heat leak into the vessel. Another device has been to elevate the bottom of the vessel typically 12 feet ( 4 meters ) or more above the pump suction. However in many installations when the liquid drops to a still appreciable level in the vessel, pump operation becomes impossible because the liquid level and the vessel pressure combined become inadequate to provide liquid with sufficient subcooling to the pump suction. In some installations pumping becomes impossible after the liquid has dropped no more than two-thirds the capacity of the vessel.

Vessel contents gradually warm up because of heat leak into the vessel. After several days of inactivity in a vessel, it is not unusual to be unable to start a pump because the liquid in the vessel has become too warm. The pressure in the vessel may have then reached the maximum allowable pressure. Vapor can then be released from the vessel allowing some liquid in the vessel to evaporate to cool the remaining liquid in the vessel and to build pressure over the liquid again. The loss of valuable liquified gas that occurs by this practice is, of course, undesirable.

It is an object of this invention to provide an apparatus and method to supply liquified gas from a vessel to a pump sump with adequate subcooling to avoid flashing and cavitation in the pump.

It is a feature of this invention that liquid recirculation between the vessel and the pump is induced by fluid density differences in the supply conduit to the pump sump and the return conduit to the vessel.

It is a feature of this invention that the fluid density difference between the supply conduit to the pump sump and the return conduit to the tank is augmented by minimizing heat leak into the supply conduit and allowing heat leak into the return conduit.

It is a feature of this invention that the liquid recirculation rate between the vessel and the pump is augmented by providing a circuit of low flow resistance.

It is another feature of this invention that a sufficient rate of recirculating flow is achieved to reduce the liquid temperature rise from heat leak in the supply conduit to the pump sump so as to avoid cavitation in the pump.

It is another feature of this invention that the supply conduit intake and return conduit discharge are located in the vessel to utilize the natural temperature stratification in the liquified gas in the vessel to provide subcooling of the liquid intake.

It is an advantage of this invention that reduced elevation of the vessel above the pump sump is required to avoid pump cavitation.

It is another advantage of this invention that reduced pressurization of the vessel is required to avoid pump cavitation.

It is another advantage of this invention that pumping without cavitation is possible when the liquid level approaches the bottom of the vessel.

It is also an advantage of this invention that pumping can be initiated after a prolonged period of inactivity.

SUMMARY OF THE INVENTION

The invention provides an apparatus for supplying from a vessel liquified gas with increased subcooling to a pump so as to avoid cavitation during pumping. The apparatus comprises:

(a) a vessel for containing liquified gas;

(b) a pump having elements forming a liquified gas flowpath;

(c) a sump for recirculation of liquified gas and cooling of the pump elements;

(d) a supply conduit for supplying liquified gas from proximate the bottom of the vessel to the pump and the sump;

(e) a return conduit for returning vapor and excess liquified gas from the pump and sump to proximate the bottom of the vessel; and (f) means for heating and thus reducing the density of vapor and excess liquified gas returning from the pump and sump so as to increase the rate of liquified gas flow from proximate the bottom of the vessel to the pump and sump.

In another embodiment, the apparatus further comprises a supply conduit intake located remote from a wall of the vessel in a cooler strata of liquified gas, and a return conduit discharge located proximate to a wall of the vessel in a warmer strata of liquified gas than the intake.

The invention also provides a method for supplying from a vessel liquified gas with increased subcooling to a pump so as to avoid cavitation during pumping. The method comprises:

(a) containing liquified gas in a vessel;

(b) providing a pump having elements forming a liquified gas flowpath;

(c) providing a sump for recirculation of liquified gas and cooling the pump elements;

(d) supplying liquified gas from proximate the bottom of the vessel to the pump and the sump;

(e) recirculating liquified gas in the sump and cooling the pump elements;

(f) returning vapor and excess liquified gas from the pump and sump to proximate the bottom of the vessel; and (g) heating and thus reducing the density of vapor and excess liquified gas returning from the pump and sump so as to increase the rate of liquified gas flow from proximate the bottom of the vessel to the pump and sump.

In another embodiment of the invention, the method further comprises locating the intake for step (d) remote from a wall of the vessel in a cooler strata of liquid, and locating the discharge for step (f) proximate a wall of the vessel in a warmer strata of liquid.

BRIEF DESCRIPTION OF THE DRAWING

The single drawing is a schematic diagram, partly in section, of an apparatus embodiment of the invention.

DESCRIPTION OF THE PREFERRED EMBODIMENTS

As shown in the drawing, liquified gas is drawn from a storage vessel 10, pressurized in a pump 12, discharged into a delivery conduit 14 and transferred to a use or distribution location. The vessel 10 contains liquified gas and vapor generated by evaporation thereof, and typically has an outer shell 16 with a space 18 between the vessel and the shell for insulation. Usually the space contains insulating matter and is evacuated of air to develop high insulating properties. Extending from the bottom of the shell 16 is a lower extension 20 which also usually contains insulation and is evacuated. Alternatively, the shell extension 20 may comprise a double walled cylinder with the space between the walls evacuated.

Proximate the bottom of the interior of the vessel 10 is an intake 21 to a supply conduit 22 which extends downward through the insulation space 18 around the vessel 10 and down into the shell extension 20. The lower end of the supply conduit 22 within the extension 20 has a loop 24 with a height of preferably not more than three conduit diameters. The supply conduit 22 extends outward approximately perpendicularly from the shell extension 20 preferably with an upward slant, and preferably at least in part has vacuum insulation 23. Vacuum insulation is accomplished by spacing a jacket around the conduit and evacuating the intermediate space.

Outside of the shell extension 20, the supply conduit 22 includes a supply conduit valve 26 and a supply conduit joint 28, typically a union, to allow removal of downstream sections of the supply conduit to facilitate repair of the pump 12 as required. The supply conduit valve 26 and the supply conduit joint 28 preferably are not vacuum insulated to facilitate opening the supply conduit joint and removing the section of supply conduit between the joint and the pump. Thus the valve 26 can be a gate valve, which is not ordinarily available as a vacuum insulated valve, and offers lower flow resistance than a globe valve, which is ordinarily available as a vacuum insulated valve. The supply conduit valve 26 and the supply conduit joint 28, however, preferably are provided with non-vacuum insulation, which is readily removable when the pump requires servicing.

Downstream of the joint 28 is a vacuum insulated fitting 30 which is the upstream end of a vacuum insulated flexible segment 32 of conduit. The fitting 30 preferably has a bend in the range of from about 30° to about 90°. The downstream end of the flexible conduit 32 has a bayonet extension 34 which inserts into a counterpart cavity in a vacuum insulated sump 36 to form a connection 38. The bayonet connection 38 is known in the art for joining a vacuum insulated conduit to another vacuum insulated conduit, or other vacuum insulated component. The upstream fitting 30 has sufficient bend and the flexible segment 32 has sufficient length so that after uncoupling the bayonet connection 38 and the joint 28, the flexible segment 32 can be slightly bent to avoid interference by the downstream portion of the joint 28 with the upstream portion of the joint 28. The bayonet extension 34 can then be withdrawn from the sump 36 without interference from other components of the apparatus. Thus the flexible segment can be short, thereby reducing its flow resistance and heat leak. For example, for a flexible segment and a sump inlet of 1½ inch nominal pipe size, the flexible segment need be not more than 10 inches ( 0.25 meters) long.

When the vessel 10 contains liquified gas and liquid circulating in supply conduit 22 is ceased by closing valve 26 or valve 44, heat leak causes evaporation of liquified gas in the supply conduit 22 outside of the shell extension 20. The vapor produced backs up the supply conduit 22 to the loop 24 where it opposes liquified gas from the vessel 10 from flowing through the loop 24. Thus liquified gas is prevented from continuously circulating to the periphery of the shell extension 20 where it would be subject to heating and evaporation by heat leak. The loop also provides flexibility in the supply conduit accommodating thermally developed forces and residual forces.

A pump 12 for pressurizing and pumping liquified gas has its suction valve 40 and other flowpath elements within the sump 36. Liquified gas is supplied to the sump 36 from the supply conduit 22 and recirculated through the sump 36 thereby cooling the pump flowpath elements and providing liquified gas to the pump suction valve 40.

Emanating from the sump 36 is a return conduit 42 which leads, preferably with an upward slant, through a return conduit valve 44 and then into the shell extension 20. Outside the shell extension, the return conduit is uninsulated at least in part so that the heat leak from the environment warms and reduces the density of the flow in the return conduit. Of course, other common means for heating the return conduit can be used. Within the shell extension 20, the return conduit 42 runs upward into the interior of the vessel 10 and discharges through a discharge 46 located proximate the bottom of the vessel 10. The density differences existing in the supply conduit 22 over the height from the supply conduit intake 21 to the pump suction valve 40 and in the return conduit 42 from the return conduit discharge 46 to the pump suction valve 40 produce a flow inducing differential of 0.01 to 0.03 psi (69 to 207 Pa).

Within the shell extension 20, emanating upwardly from the return conduit 42, is a vapor conduit 48 which loops outside of the shell extension 20 to include a valve 50, and then runs to proximate the top of the vessel 10. Alternatively the vapor conduit 48 can be located without the shell extension 20. Downstream of the entering vapor conduit 48, the return conduit 42 has a loop 52, with a height of preferably not more than three conduit diameters. The loop 52 in the return conduit has identical functions as the loop 24 in the supply conduit. When the return conduit 42 is closed off by valves 44 and 50, or 50 and 26, liquified gas is deterred from flowing downstream through the loop 52 by opposing vapor produced by heat leak upstream of the loop 52. The loop 52 also provides flexibility in the return conduit thereby relieving thermally developed forces and residual forces. In addition, when the vessel 10 contains liquified gas and the return conduit 42 and the vapor conduit 48 are open, i.e., not closed off by their respective valves, vapor is deterred from flowing downward in the loop 52 by liquified gas and thus promoted to flow upward into the vapor conduit 48. Thus the loop 52 functions in normal service to separate vapor from liquid.

Emanating from the pump discharge 54 is a delivery conduit 14 including a check valve 56. Originating at the pump discharge 54, or a location in the delivery conduit 14 between the pump discharge 54 and the check valve 56, is an unloading conduit 58 including an unloading conduit valve 60. The unloading conduit 58 discharges into the return conduit 42 at a location between the sump 36 and the return conduit valve 44. The discharge from the unloading conduit 58 is through a means 62 which induces flow in the return conduit 42. The means is one of any number of commonly available jet pumps or flow inducers operating to induce flow of a fluid using the flow energy of another fluid. Usually the pump 12 is started with the unloading valve 60 open, thus allowing pumped fluid to enter the return conduit 42 and assist inducing flow in the return conduit 42, which in turn induces flow in the supply conduit 22.

Quiescent liquified gas in the vessel 10 develops a temperature and density stratification because of heat leak from the environment. In a typical cylindrical storage vessel with, for example, a diameter of 2 feet (0.61 meters) and a height of 7 feet (2.1 meters), the liquified gas contents typically are 11 K degrees warmer at the top than at the bottom, and 4 K degrees warmer at the wall than at the center. Thus in terms of subcooling, liquid at bottom center in the vessel has greater subcooling than liquid at the top or at the wall of the vessel. To avoid flashing or cavitation in the pump, advantage is taken of the natural stratification in the liquid in the vessel to supply cooler liquid, that is, liquid having greater subcooling, to the pump. The supply conduit intake 21 is located away from the vessel wall 64 and proximate the bottom of the vessel 10 to draw liquid from a cool strata in the vessel. The return conduit discharge 46 is located proximate to the wall 64 of the vessel to discharge returning warmed fluid into a warm strata in the vessel. A baffle 66 is provided between the intake and discharge to assist in maintaining the natural stratification. An alternate configuration is a baffle at the intake and a baffle at the discharge.

The vessel 10 is elevated so that the supply conduit intake is only approximately 7 feet (2.1 meters) above the pump suction 40, whereas prior art installations have typically required an elevation twice as great. In this invention, with the pump not operating and only 20 psig (137,800 Pa) pressure developed by evaporated liquified gas in the vessel, the circulation rate of liquified gas developed through the sump is in the range of 0.5 to 3 gallons per minute (3.2 to $19\times10^{-5}$ cubic meters per second). Heat leak into the supply conduit is essentially independent of the circulation rate. Thus with the achieved circulation rate, the temperature rise in the fluid in the supply conduit enroute to the pump is relatively small. The small temperature rise and the low pressure drop in the supply conduit contribute in allowing the liquified gas to reach the pump with sufficient subcooling to avoid flashing or cavitation in the pump when operation is started.

Thus several features in the invention apparatus serve to cause the liquified gas circulation rate and delivery to the pump in a state to avoid flashing or cavitation in the pump when operation is started. One is the low flow resistance of the supply and return conduits. Another is the location of the supply conduit intake away from the vessel wall in a cool strata of liquid in the vessel. Another is the maintenance of the natural stratification in the liquid in the vessel by the location of the return conduit discharge nearer the wall and the provision of a baffle. Another is the low heat leak into the supply conduit achieved by efficient insulation, preferably vacuum insulation, of the supply conduit. Another is the shortness of the supply conduit itself which provides reduced surface for heat leak. Yet another is the warming of the fluid and the reduced fluid density achieved in the return conduit by the non-vacuum insulated portion of the return conduit. Thus the static fluid head provided by the higher density fluid in the supply conduit over its height from the conduit intake to the pump suction is significantly greater than the head provided by the lower fluid density in the return conduit over its height from the conduit discharge to the pump suction. The differential head developed between these two sections of the circuit is sufficient to induce the aforementioned circulation rate and achieve the small temperature rise in the liquid delivered to the pump. The subcooling achieved is adequate to allow pump startup and operation even at liquid levels in the vessel which approach the supply conduit intake and return conduit discharge.

What is claimed is:

1. An apparatus for supplying from a vessel to a pump liquified gas with subcooling so as to avoid cavitation during pumping, said apparatus comprising:

(a) a liquified gas vessel;

(b) a pump having elements forming a liquified gas flowpath;

(c) a sump means for recirculation of liquified gas and cooling said pump elements;

(d) a supply conduit means for supplying liquified gas from proximate the bottom of said vessel to said pump and said sump;

(e) a return conduit means for returning vapor and excess liquified gas from said pump and sump to proximate the bottom of said vessel; and (f) means for heating and thus reducing the density of vapor and excess liquified gas returning from said pump and sump so as to increase the rate of liquified gas flow from proximate the bottom of said vessel to said pump and sump.

2. The apparatus as in claim 1 wherein said means for heating comprises at least a portion of said return conduit means being exposed for heating by natural convection from atmosphere.

3. The apparatus as in claim 1 further comprising a vapor conduit running from proximate the top of said vessel and entering from above into said return conduit means.

4. The apparatus as in claim 3 further, comprising a loop in said return conduit means downstream of the entering of said vapor conduit so that when said vessel contains liquified gas, and said return conduit means and said vapor conduit are not closed off, vapor is deterred from flowing downward in said loop by liquified gas and thus promoted to flow upward into said vapor conduit, and when said return conduit means and said vapor conduit are closed off, liquified gas is deterred from flowing downstream through said loop by opposing vapor upstream of said loop.

5. The apparatus as in claim 1 further comprising a loop in said supply conduit means so that when said vessel contains liquified gas and said supply conduit is closed off, liquified gas is deterred from flowing downstream through said loop by opposing vapor upstream of said loop.

6. The apparatus as in claim 1 wherein said supply conduit means and said return conduit means are at least partially insulated.

7. The apparatus as in claim 1 further comprising a pump discharge, an unloading conduit running from said pump discharge and entering said return conduit downstream of said sump, and an unloading conduit valve in said unloading conduit.

8. The apparatus as in claim 7 further comprising means for inducing flow in said return conduit means by using the flow entering from said unloading conduit.

9. The apparatus as in claim 1 further comprising a supply conduit intake located remote from a wall of said vessel in a cooler strata of liquified gas, and a return conduit discharge located proximate to a wall of said vessel in a warmer strata of liquified gas than said intake.

10. The apparatus as in claim 9 further comprising a baffle between said intake and said discharge to maintain and enhance stratification in the liquified gas contents of said vessel.

11. The apparatus as in claim 1 wherein said supply conduit means includes a segment of vacuum insulated flexible conduit having an upstream and downstream and, the upstream end of said segment having a fitting with a bend, said fitting connecting to a joint, said joint connecting to a valve, the downstream end of said segment having a connection with said sump means, said connection having an extension for insertion into said sump means, said fitting having sufficient bend and said segment having sufficient length so that after uncoupling said upstream joint and said downstream connection, said segment can be bent and said extension can be withdrawn from said sump means without interference from other components of said apparatus.

12. The apparatus as in claim 11 wherein said valve is a gate valve and said valve and said joint are insulated with non-vacuum insulation.

13. An apparatus for supplying from a vessel to a pump liquified gas with subcooling so as to avoid cavitation during pumping, said apparatus comprising:

(a) a liquified gas vessel;

(b) a pump having elements forming a liquified gas flowpath;

(c) a sump means for recirculation of liquified gas and cooling said pump elements;

(d) a supply conduit means for supplying liquified gas from proximate the bottom of said vessel to said pump and said sump;

(e) a return conduit means for returning vapor and excess liquified gas from said pump and sump to proximate the bottom of said vessel, (f) a supply conduit intake located remote from a wall of the vessel and in a cooler strata of liquified gas; and (g) a return conduit discharge located proximate to a wall of said vessel and in a warmer strata of liquified gas than said intake.

14. The apparatus as in claim 13 further comprising a baffle between said intake and said discharge to maintain and enhance stratification when said vessel contains liquified gas.

15. The apparatus as in claim 13 wherein said means for heating comprises at least a portion of said return conduit means being exposed for heating by natural convection from atmosphere.

16. A method for supplying from a vessel to a pump liquified gas with subcooling so as to avoid cavitation during pumping, said method comprising:

(a) containing liquified gas in a vessel;

(b) providing a pump having elements forming a liquified gas flowpath;

(c) providing a sump for recirculation of liquified gas and cooling said pump elements;

(d) supplying liquified gas from proximate the bottom of said vessel to said pump and said sump;

(e) recirculating liquified gas in said sump and cooling said pump elements;

(f) returning vapor and excess liquified gas from said pump and sump to proximate the bottom of said vessel; and (g) heating and thus reducing the density of vapor and excess liquified gas returning from said pump and sump so as to increase the rate of liquified gas flow from proximate the bottom of said vessel to said pump and sump.

17. The method as in claim 16 further comprising locating the intake for step (d) remote from a wall of the vessel and in a cooler strata of liquified gas, and locating the discharge for step (f) proximate a wall of the vessel and in a warmer strata.

18. The method as in claim 17 further comprising reducing the flow friction losses plus the heat leak in step (d) to leave sufficient subcooling in the pump sump liquid for pump operation from the subcooling provided by the pressure above the liquid in the vessel plus the liquid level head in the vessel plus the differential head between the flows in steps (d) and (f) plus the subcooling achieved by providing the intake for step (d) remote from a wall of the vessel and the discharge for step (f) proximate to a wall of the vessel.

19. The method as in claim 16 further comprising separating vapor from liquified gas flowing from said pump and sump and conducting the vapor to proximate the top of said vessel.

* * * * *